United States Patent [19]

Morse

[11] Patent Number: 5,066,930

[45] Date of Patent: Nov. 19, 1991

[54] HIGH EFFICIENCY DIODE PHASE SHIFTER

[75] Inventor: Alfred W. Morse, Ellicott City, Md.

[73] Assignee: Westinghous Electric Corp., Pittsburgh, Pa.

[21] Appl. No.: 600,650

[22] Filed: Oct. 22, 1990

[51] Int. Cl.[5] ..... H01P 1/185

[52] U.S. Cl. ..... 333/164; 333/161

[58] Field of Search ..... 333/116, 103, 117, 161, 333/164, 156, 138, 139

[56] References Cited

U.S. PATENT DOCUMENTS

| | | | |
|---|---|---|---|
| 3,436,691 | 4/1969 | Hoffman et al. | 333/164 |
| 3,718,873 | 2/1973 | Garver | 333/164 |
| 4,205,282 | 5/1980 | Gipprich | 333/164 X |
| 4,423,393 | 12/1983 | Freitag et al. | 333/164 |
| 4,614,921 | 9/1986 | Yarman | 333/164 X |
| 4,859,972 | 8/1989 | Franke et al. | 333/164 |

*Primary Examiner*—Eugene R. LaRoche
*Assistant Examiner*—Seung Ham
*Attorney, Agent, or Firm*—W. G. Sutcliff

[57] ABSTRACT

In one embodiment a diode phase shifter has a four port coupler formed of a pair of RF coupled transmission lines. The coupler has an input port on one transmission line and an output port on the other, and each transmission line has a tunable port. Serially interconnected RF isolated gateable diodes are provided, one diode is coupled to the tunable port on one transmission line and the other diode is connected to the other tunable port. The diodes approximate a microwave open circuit when reverse biased and approximate a microwave short circuit when forward biased to a conducting state. In another embodiment a diode phase shifter employing a single stripline is described.

17 Claims, 3 Drawing Sheets

HIGH EFFICIENCY DIODE PHASE SHIFTER

BACKGROUND OF THE INVENTION

1. Field of the Invention

This invention relates a diode phase shifter and in particular the invention relates to a high efficiency diode phase shifter employing isolated RF and DC circuits with series PIN diodes.

2. Description of the Prior Art:

PIN diodes are commonly used in microwave switching devices and phase shifters. A PIN diode approximates a microwave open circuit when reverse biased and approximates a microwave short circuit when conducting with DC forward bias current.

FIG. 1 shows a commonly used configuration of a single bit digital PIN diode phase shifter in a coupler 10 employing a pair of λ/4 microwave or RF transmission lines 12 and 14. In an ideal coupler all the RF power entering input port A splits and is divided equally between ports B and C, with port D being isolated. The split power components at ports B and C reflect off the diodes D1 and D2, which are both selectively reverse or forward biased by the power supply 16 to be either open or short circuit respectively. The power components reenter the coupler at ports B and C. By elementary coupler theory, which need not be discussed in detail here, the power then recombines and exits the output port D. The transmission phase of the circuit between ports A and D is a two state function of the diode states; i.e. either conduction or non-conduction. It should be understood that the power supply 16 is isolated from the RF circuit by the RF chokes 18 and 20 which are coupled to the respective transmission lines 12 and 14. DC current flows through the chokes 18 and 20, the transmission line 14 and the diodes D1 and D2 to ground G.

The current iD1 and iD2 in the respective diodes D1 and D2 result in considerable control circuit power dissipation. The power required for control of the phase shifter bit is equal to the total diode current iD1+iD2 multiplied by the power supply voltage which is typically about 5 volts. For example, if each diode D1 and D2 requires a 50 ma current to induce a low microwave impedance, a total of 100 ma must be drawn from the 5 volts power supply 16 in order to accomplish the function.

In a radar phase shifter there are several of these diodes circuits per phase shifter, and hundreds to thousands of phase shifters per antenna. The power dissipation due to the control of thousands of diodes is a major design problem in many systems, and can result in DC power losses of hundreds of watts. In some applications, such as in spacecraft, the prime power required the drive thousands of diodes places severe limitations on the system practicality. Likewise, cooling requirements of such systems are often expensive, bulky and heavy, further limiting practical applications, especially in air borne systems.

SUMMARY OF THE INVENTION

The present invention has been designed to obviate the limitations of the described prior arrangements. In particular, there is described means for reducing the total diode current, and therefore the total prime power and power dissipation, by a factor of 2.

The invention comprises in one embodiment a four port microwave coupler formed of a pair of RF coupled transmission lines. The coupler has an input port on one transmission line and an output port on the other transmission line, and each transmission line has a selectably tunable port. Serially interconnected gateable diodes are provided, the first diode is coupled to the tunable port on one transmission line and the other diode is connected to the other tunable port. The diodes approximate a microwave open circuit when reverse biased and approximate a microwave short circuit when forward biased to a conducting state. In another embodiment a loaded stripline having serially interconnected gating diodes is described.

DESCRIPTION OF THE PREFERRED EMBODIMENT

Figure 1:
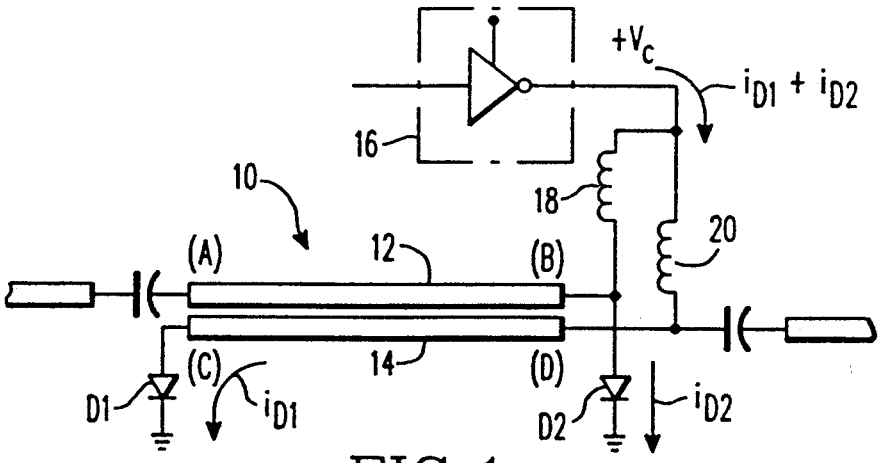
FIG. 1 PRIOR ART
FIG. 1 is a schematic illustration of conventional diode phase shifter employing parallel connected diode switches.
Figure 2:
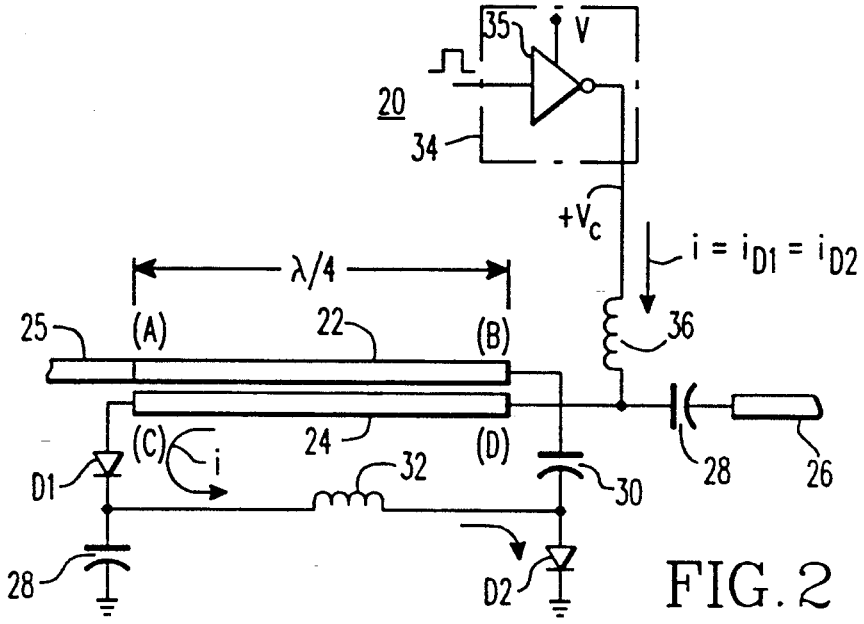
FIG. 2 is a schematic illustration of the high diode phase shifter of the present invention employing series connected diodes.

FIG. 2 illustrates the circuit configuration of a phase shifter bit 20 according to the present invention.

In the arrangement first and second coupled λ/4 transmission lines 22 and 24 are arranged as shown throughout the disclosure. It is to be understood that λ/4 typically the wavelength of a frequency of interest, e.g. the center frequency of the phase shifter 20. The first transmission line 22 has an input port A coupled to a microwave input circuit 25 which is not shown in detail. The second transmission line 24 has an output port D coupled to an output circuit 26 which is also not illustrated in detail. The output port D is coupled to the output circuit 26 by a coupling capacitor 28 which blocks DC.

Each of the first and second transmission lines 22 and 24 have respective tunable ports B and C. Tunable port C is coupled to a diode D1 and tunable port B is coupled to a diode D2. The first diode D1 is coupled to ground G by a coupling capacitor 28 and likewise the second diode D2 is coupled in series to ground with the coupling capacitor 30. The coupling capacitors 28 and 30 isolate those legs of the circuit from DC current as hereinafter described. The diodes D1 and D2 are connected in series through RF isolating choke 32.

A power supply 34 is coupled to the transmission line 24, as shown, through an isolating RF choke 36.

The power supply 34 selectively provides $+V_c$ voltage in a DC circuit by means of selectable driver 35. The DC circuit includes series of RF choke 36, the second transmission line 24, diode D1, RF choke 32 and diode D2 coupled to ground G. The total current in the circuit equals approximately the current flowing in diode D1 (iD1) which is equal to the current flowing in diode D2 (iD2). Thus for example, the total diode current is simply the current of one diode. In the example referred to above if each diode requires 50 ma of current to induce a low microwave impedance in the series arrangement illustrated in FIG. 2 a total diode current of 50 ma is required in the series circuit. Accordingly, the current flowing from the power supply is one half, and the total dissipated power and prime power requirements are also reduced by one half, thus resulting in a significant advantage for large phased array systems.

The capacitors 28 and 30 function as DC blocks, that is, the capacitors are open circuits to DC control voltages and current while the capacitors act as microwave short circuits. Thus, when the diodes D1 and D2 are conducting the tunable ports B and C are microwave short circuits. However, when diodes D1 and D2 are reverse bias the ports B and C are microwave open circuits.

Figure 2A:
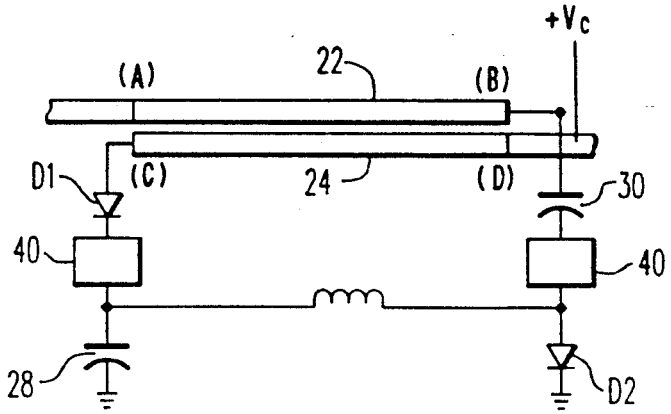
FIG. 2A schematically illustrates an embodiment of the invention employing for an impedance loading the coupler.

FIG. 2A illustrates a variation of the invention in which a pair of identical reactive impedances 40 are in series connection with the respective tunable ports C and D and the diodes D1 and D2 to ground. In such an arrangement, the impedances 40 may be employed to regulate the amount of phase shift desired in the circuit. In the embodiment illustrated, the impedances 40 are the same for balanced operation although it is conceivable that unbalanced impedance may be employed if desired.

Figure 3A:
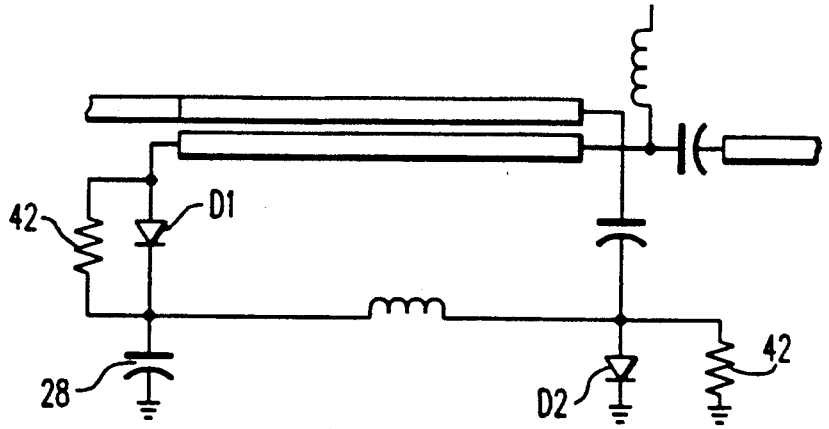
FIGS. 3A-3D are schematic illustrations of the invention in which resistive and reactive components are employed to balance reverse diode bias and RF.

FIGS. 3A-3D illustrate variations of the circuit shown in FIG. 2. In FIG. 3A a resistor 42 is coupled in shunt around each diodes D1 and D2 as illustrated. The resistors 42 have the same resistance and balance the reverse bias voltage on each diode. It is known that diodes have predictable and stable forward voltage drops. However, when reverse bias diodes may have varying resistance. If the resistance 42 is low with respect to the resistance of the diodes D1 and D2 in the reverse bias condition, resistance 42 predominates and the circuit is balanced.

Figure 3B:
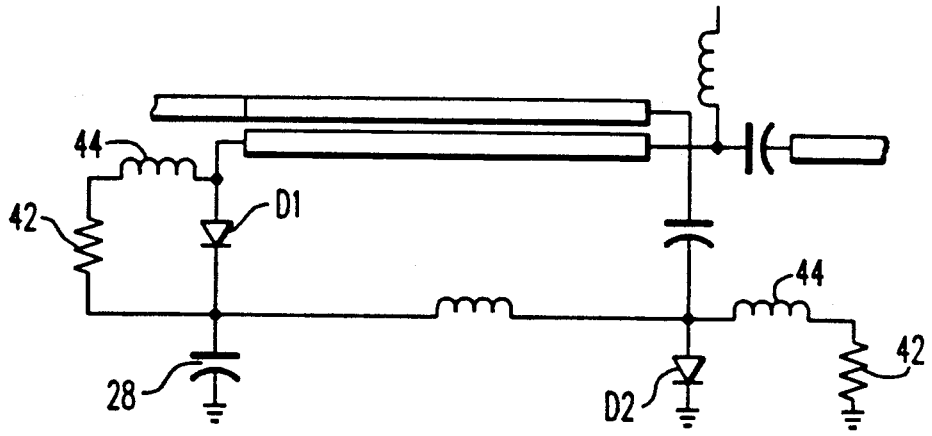
Figure 3C:
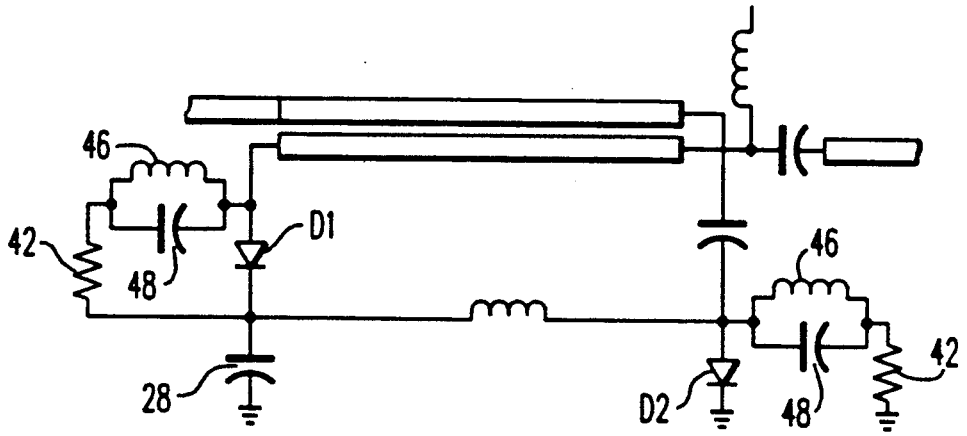
Figure 3D:
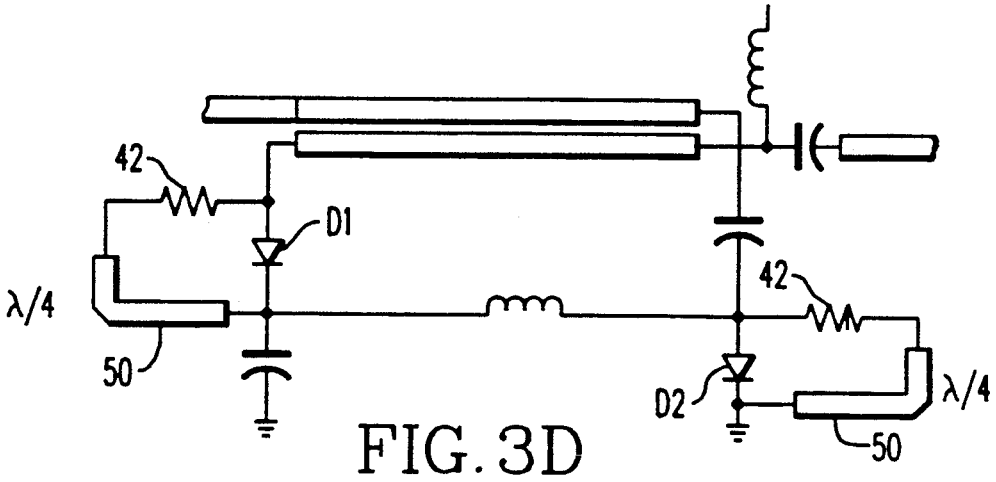

In FIG. 3B an additional RF choke 44 is series connected with the shunt resistor 42 in order to isolate RF currents in the balancing resistors 42 which maintain balanced reverse bias conditions in a manner similar to the arrangement of FIG. 3A. In FIG. 3C a parallel connected inductor 46 and capacitor 48 is series connected with the shunt resistor 42 to provide increased microwave isolation by means of a parallel resonant circuit which is tuned a microwave frequency of interest. In FIG. 3D a quarter wavelength $\lambda/4$ stripline 50 is used as a distributed equivalent of the resonant circuit in FIG. 3D.

Figure 4:
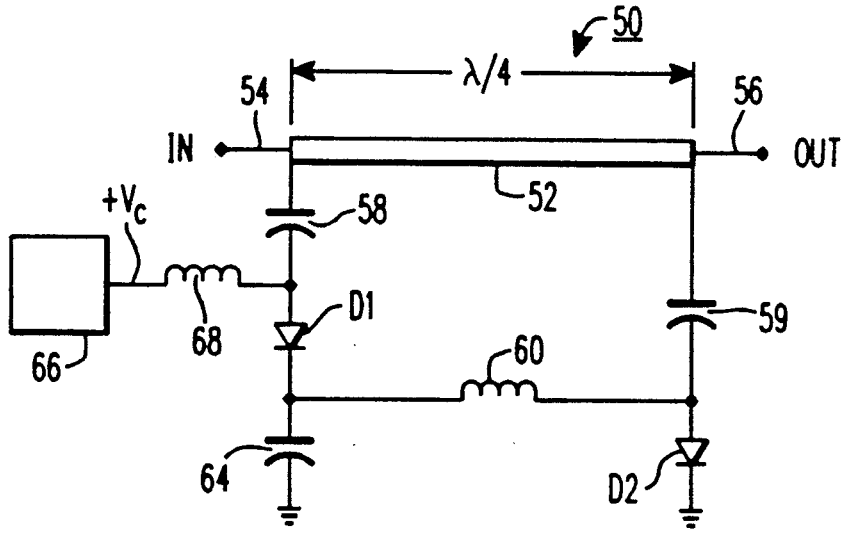
FIG. 4 is a schematic illustration of a series PIN diode technique in a shunt loaded transmission line phase shifter.

The various arrangements illustrated hereinbefore are examples of a phase shifter bit circuit according to the present invention. However, numerous different configurations may be use with the concept herein described. For example, the invention is also applicable to arrangements employing two diodes with other types of hybrids such as phase shifter 50 illustrated in FIG. 4. $\lambda/4$ stripline 52 carries an RF signal from the input 54 to output 56. Loading capacitors 58-59 cause a phase shift in the signal. The capacitors 58 are separated by a quarter wavelength $\lambda/4$ of the frequency of interest. In the arrangement, the diodes D1 and D2 are series connected through RF choke 60 and to the opposite ends of the phase shifter 50 through load capacitors 58. Diode D1 is serially coupled to ground G in a manner similar to the arrangement of FIG. 2, by means of capacitor 64 and loading capacitor 59. Diode D2 is similarly coupled between ground and output port 56 by load capacitor 58. For balance a coupling capacitor may be provided in the circuit of diode D2. A selectable V+ source 66 supplies DC to diodes D1 and D2 through RF choke 68. Capacitor 64 provides a DC block to ground while each of the diodes D1 and D2 are coupled to ground in the RF sense as aforesaid.

While there has been described what at present is believed to be the preferred embodiment of the present invention, it will be apparent to those skilled in the art the various changes and notifications may made therein without departing from the invention, and is intended in the appended claims to cover all such modifications and changes that come within true spirit and scope of the invention.

What is claimed is:

1. A diode phase shifter comprising a four port microwave coupler formed of a pair of RF coupled first and second transmission lines, said coupler having an input port and a first tunable port on the first transmission line and an output port and a second tunable port on a second transmission line;

first and second serially interconnected gateable diode means, the first diode means being coupled to the first tunable port and the second diode means being coupled to the second tunable port, said diode means for shunting the first and second tunable ports when forward biased and for opening the first and second tunable ports when reverse biased; and RF coupling means in series with each of the tunable ports and each of the first and second diode means for providing an RF path to ground for each diode means and for isolating the path from DC current.

2. The diode phase shifter of claim 1 further comprising RF isolating means serially coupled between the first and second diodes being operative to allow DC between the diode and for blocking RF therebetween.

3. The diode phase shifter of claim 1 wherein the RF coupling means comprises a capacitor in series with each of the diode means.

4. The diode phase shifter of claim 1 further comprising biasing means for the first and second diode means for providing forward and reverse biasing thereon.

5. The diode phase shifter of claim 4 further comprising RF isolating means coupled between the biasing means and the first and second diode means.

6. The diode phase shifter of claim 1 wherein the first and second diode means have differing reverse bias resistance and further comprising impedance means for bridging the first and second diode means for balancing the reverse bias resistance of said first and second diode means.

7. The diode phase shifter of claim 6 wherein the impedance means has a resistive characteristic which is small compared to the reverse bias resistance of each of the first and second diode means.

8. The diode phase shifter of claim 7 wherein the impedance means comprises a shunt resistor.

9. The diode phase shifter of claim 7 wherein the impedance means comprises an inductive reactance.

10. The diode phase shifter of claim 7 wherein the impedance means comprises a tuned resonant circuit in shunt with the diode means.

11. The diode phase shifter of claim 7 wherein the impedance means comprises a stripline having a length equal to the quarter wavelength of a frequency of interest.

12. The diode phase shifter of claim 1 further comprising means serially connected in between the first and second diode means for providing RF isolation therebetween while allowing the flow of DC current for biasing the diodes in forward and reverse bias conditions.

13. The diode phase shifter of claim 1 wherein the transmission line has a length $\lambda/4$ where $\lambda$ is the wavelength of a frequency of interest.

14. A DC phase shifter comprising:

a least one stripline, having a length equal to a quarter wavelength of a microwave frequency of interest;

microwave reactive loading means at ends of the stripline;

first and second diode means one each coupled in series with their reactive loading means and serially interconnected said first and second diode means for approximately a microwave open circuit when the diodes are reversed biased and approximately a microwave short circuit when the diodes are forward biased to a conducting state; and RF coupling means in series with at least one of the diodes for providing an RF path to ground therefor, the other of said diode means being coupled to ground through its reactive loading means.

15. A diode phase shifter of claim 14 wherein the stripline has a length $\lambda/4$ separating the reactive loading means where $\lambda$ is the wavelength of a frequency of interest.

16. A diode phase shifter comprising:

a four port microwave coupler formed of a pair of RF coupled first and second transmission lines, said coupler having an input port and a first tunable port on the first transmission line and an output port and a second tunable port on the second transmission line;

first and second serially interconnected gateable diode means, the first diode means being coupled to the first tunable port and the second diode means being coupled to the second tunable port, said diode means for shunting the first and second tunable ports when forward biased and for opening the first and second tunable ports when reverse biased;

RF isolating means serially coupled between the first and second diode means being operative to allow DC between the diodes and for blocking RF therebetween; and RF coupling means in series with each of the tunable ports and each of the first and second diode means for providing an RF path to ground for each diode means and for isolating each path from DC current.

17. A DC phase shifter comprising:

at least one stripline, having a length equal to a quarter wavelength of a microwave frequency of interest;

microwave reactive loading means at ends of the stripline;

first and second diode means one each coupled in series with their reactive loading means and serially interconnected said first and second diode means for approximating a microwave open circuit when the diodes are reverse biased and approximating a microwave short circuit when the diodes are forward biased to a conducting state; an RF circuit including RF coupling means in series with at least one of the diodes for providing an RF path to ground therefor, the other of said diode means being coupled to ground through its reactive loading means; and a DC circuit including RF isolating means coupled in series between the diodes.

* * * * *